US006234441B1

(12) United States Patent
Gordon

(10) Patent No.: US 6,234,441 B1
(45) Date of Patent: May 22, 2001

(54) BOOK STAND

(76) Inventor: Jerry E. Gordon, 1218 S. 24th Ct., West Des Moines, IA (US) 50265

( * ) Notice: Subject to any disclaimer, the term of this patent is extended or adjusted under 35 U.S.C. 154(b) by 0 days.

(21) Appl. No.: 09/491,218

(22) Filed: Jan. 25, 2000

Related U.S. Application Data

(63) Continuation of application No. 09/209,175, filed on Dec. 10, 1998, now Pat. No. 6,027,092.

(51) Int. Cl.[7] ..... A47B 97/04; A47B 5/04

(52) U.S. Cl. ..... 248/444; 248/444.1; 248/447; 248/451

(58) Field of Search ..... 248/447.2, 462, 248/463, 444.1, 444, 445, 446, 447, 448, 454, 455, 457, 458, 460, 451

(56) References Cited

U.S. PATENT DOCUMENTS

| | | | | |
|---|---|---|---|---|
| 571,254 | * | 11/1896 | Whitmore | 248/453 |
| 758,924 | | 5/1904 | Law | 248/447.2 |
| 1,602,338 | | 10/1926 | Chittenden | 248/448 |
| 1,928,926 | | 10/1933 | Busby | 248/446 |
| 1,945,931 | | 2/1934 | Boyle | 248/448 |
| 2,359,895 | * | 10/1944 | Burton | 248/445 |
| 3,408,032 | * | 10/1968 | Francis | 248/445 |
| 3,514,066 | * | 5/1970 | Singleton et al. | 248/445 |
| 4,596,372 | | 6/1986 | Ford et al. | 248/444.1 |
| 5,112,021 | | 5/1992 | Greene | 248/444.1 |
| 5,671,900 | | 9/1997 | Cutler | 248/451 |
| 5,829,787 | * | 11/1998 | Newhouse, Jr. | 248/46 |
| 5,971,343 | * | 10/1999 | Marlak | 248/441.1 |
| 5,971,344 | * | 10/1999 | Ainsworth | 248/445 |
| 5,979,857 | * | 11/1999 | Holm | 248/451 |
| 6,042,065 | * | 3/2000 | Benjamin | 248/125.1 |
| 6,089,609 | * | 7/2000 | Denley | 281/42 |

* cited by examiner

*Primary Examiner*—Anita M. King
*Assistant Examiner*—N. Morrison
(74) *Attorney, Agent, or Firm*—Zarley, McKee, Thomte, Voorhees & Sease

(57) ABSTRACT

A book stand is provided with a base adapted to fit under a person's leg, a first arm pivotally connected to the base, a second arm telescopically attached to the first arm, and a book rack pivotally mounted on the second arm for supporting a book. An I-shaped page retainer is pivotally mounted on the rack and includes laterally extending upper and lower fingers for holding opposing pages of the book open for reading. The page retainer includes telescoping segments such that the distance between the fingers can be adjusted to accommodate different size books. A book light optionally can be attached to the book rack for lighting the pages.

14 Claims, 4 Drawing Sheets

BOOK STAND

This application is a continuation of U.S. Ser. No. 09/209,175 filed Dec. 10, 1998, now U.S. Pat. No. 6,027,092.

BACKGROUND OF THE INVENTION

Book stands for holding books are well known. Typically, prior art book stands include a base, an arm extending upwardly from the base, and a rack for holding the book. The rack on prior art book stands normally includes fingers for holding the pages open.

Such conventional book stands usually rest upon the floor, and thus are relatively large, and heavy so as to provide stability. Also, these conventional book stands are complex in construction, and thus expensive to manufacture and sell.

Accordingly, the primary objective of the present invention is the provision of an improved book stand for holding open the pages of a book for reading.

Another objective of the present invention is the provision of a book stand which is lightweight, yet stable.

Another objective of the present invention is the provision of a book stand which holds the pages of the book open without interference.

A further objective of the present invention is the provision of a book stand which allows quick and easy turning of the pages.

Another objective of the present invention is the provision of a book stand having a base upon which a person sits to stabilize the stand.

A further objective of the present invention is the provision of a book stand which is portable.

Still another objective of the present invention is the provision of a book stand which is economical to manufacture and durable in use.

These and other objectives of the invention will become apparent from the following description of the invention.

SUMMARY OF THE INVENTION

The book stand of the present invention is lightweight and portable. The stand includes a base which is adapted to be sat upon by a person in a chair so as to stabilize the base. First and second arms extend upwardly from the base and are telescopically joined to provide height adjustment. A book rack is attached to the second arm and includes a shelf for holding a book. The rack is pivotally mounted for rotation about a horizontal axis, such that the angle of the book can be adjusted. The first arm is pivotally connected to the base for movement about a horizontal axis such that the spacing between the book rack and the reader can be adjusted. The rack includes an I-shaped page retainer, including a central beam extending along the inner spine of the book and laterally extending fingers to hold opposing pages of the book open for reading. The page retainer is pivotally attached to the rack for movement between a first position engaging the open book pages, and a second position disengaged from the pages so that the pages can be turned. The central beam of the page retainer includes telescoping segments such that the distance between the upper and lower fingers can be adjusted, thereby accommodating different sized books. A light may be mounted on the rack to illuminate the book pages.

A BRIEF DESCRIPTION OF THE DRAWINGS

DETAILED DESCRIPTION OF THE INVENTION

Figure 1:
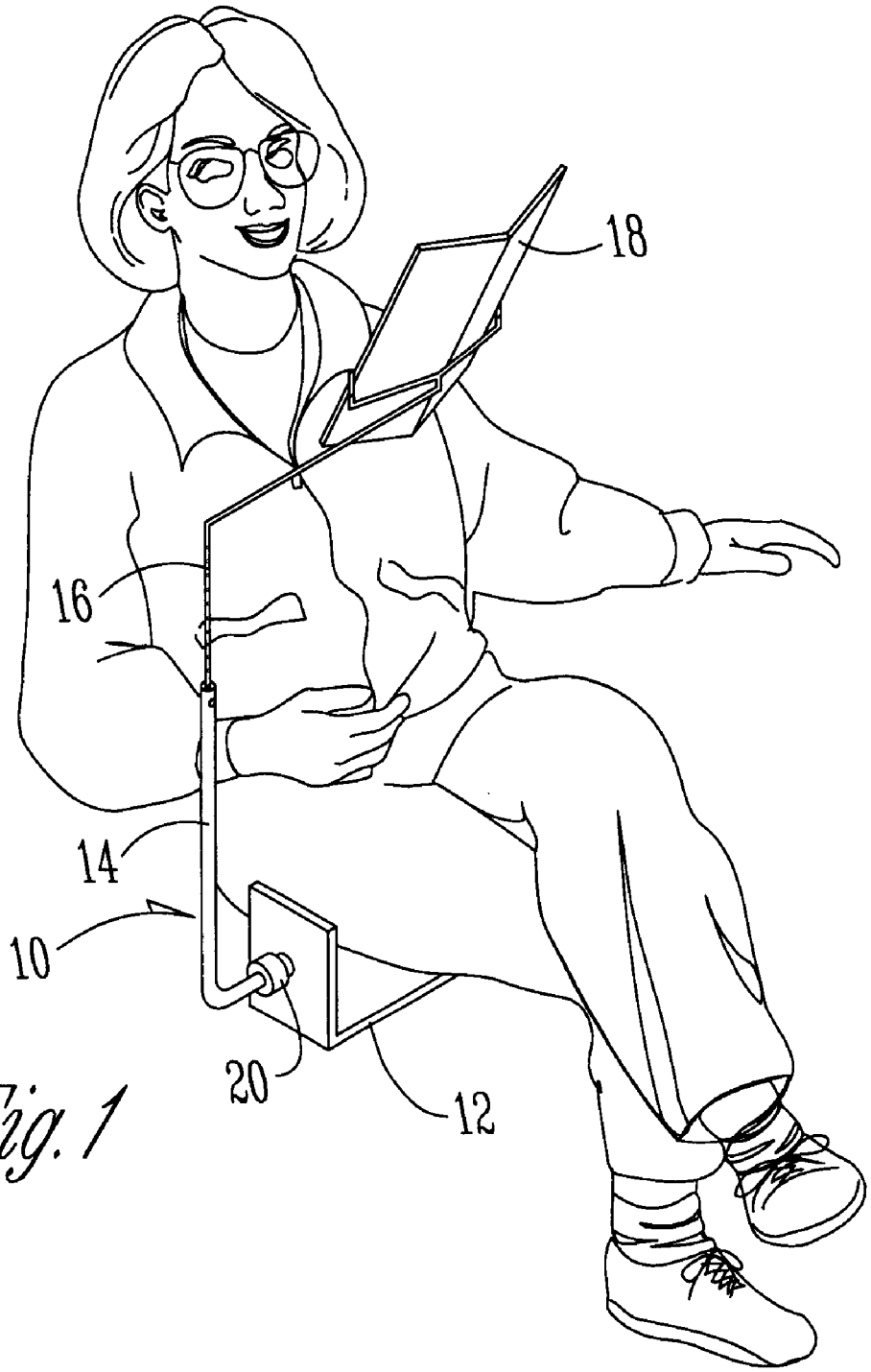
FIG. 1 is a perspective view of the book stand of the present invention in use.

The book stand of the present invention is generally designated in the drawings by the reference numeral 10. The stand 10 includes a base 12, a first arm 14 pivotally connected to the base 12, a second arm 16 telescopically extending from the first arm 14, and a book rack 18 supported on the second arm 16.

More particularly, the first arm 14 is L-shaped, with the lower end being connected to the base 12 by a pivot connector 20 such that the arm 14 is pivotal about a horizontal axis. The pivot connector as shown in the drawings includes a fixed member 22 secured on the base 12 by a shaft 23 and an adjustment member 24 which supports the first arm 14. The adjustment member 24 is spring mounted to the fixed member 22 and includes a pair of pins 26 which can be selectively received in the holes 28 in member 22 so that the angular position of the first arm 14 can be selectively fixed. Thus, member 24 can be pulled away from member 22 and then rotated until the arm 14 is in a desired position. The member 24 is then released so as to spring back toward member 22 with the pins 26 in the selected holes 28. It is understood that any conventional pivot joint can be utilized for the connection between the first arm 14 and the base 12, without departing from the scope of the present invention.

Figure 2:
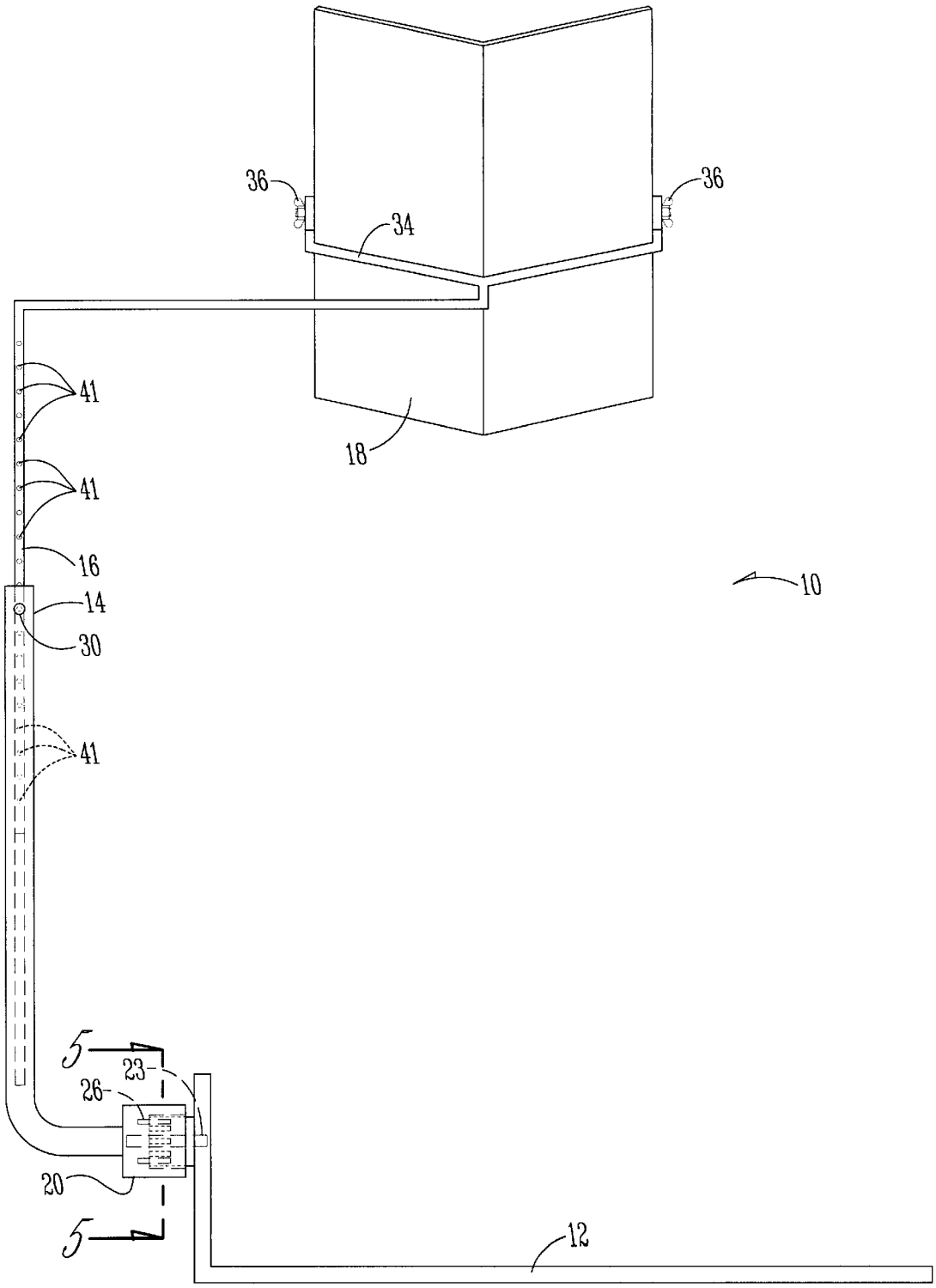
FIG. 2 is a rear elevation view of the book stand of the present invention.
Figures 3, 4:
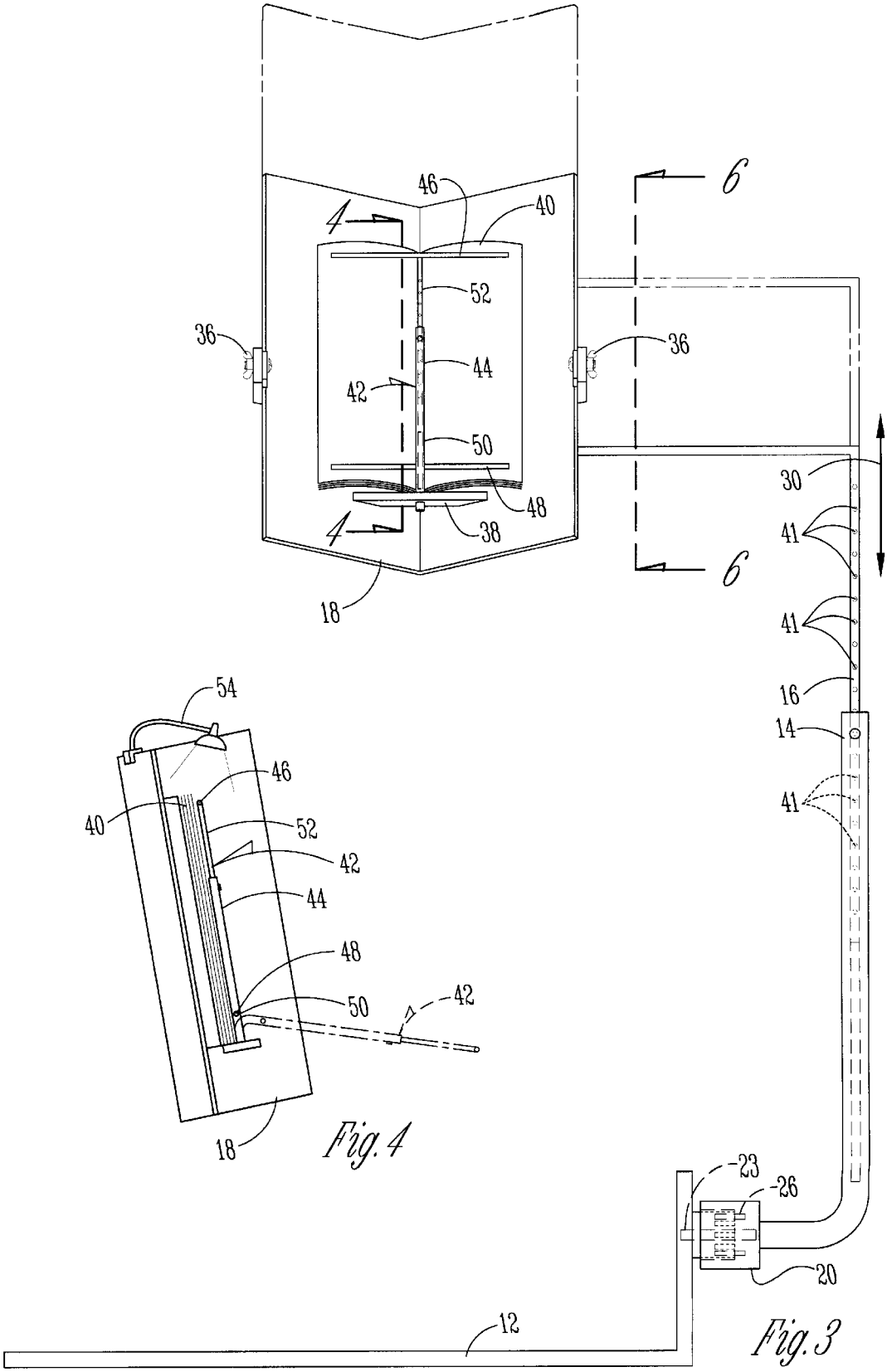
FIG. 3 is a front elevation view of the book stand of the present invention.
FIG. 4 is a sectional view taken along lines 4—4 of FIG. 3.
Figure 5:
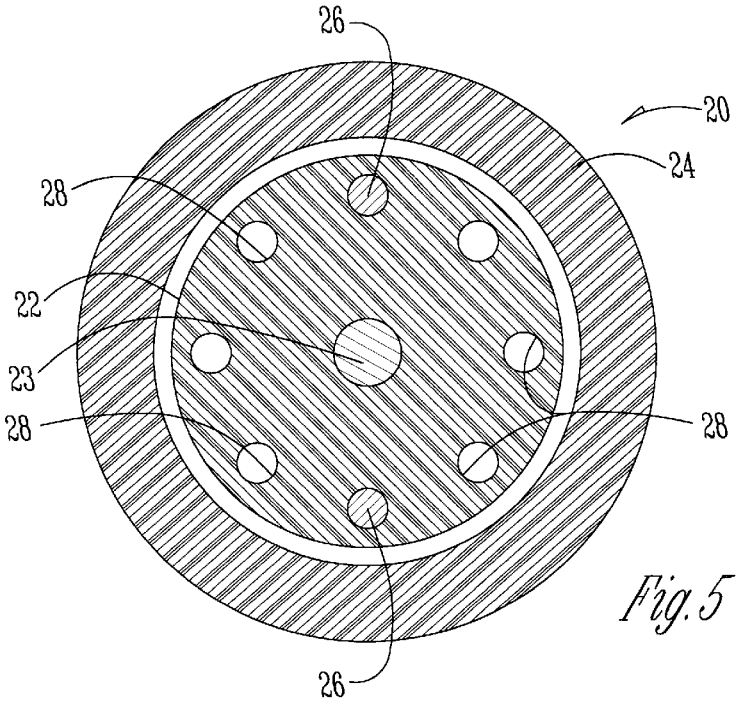
FIG. 5 is a sectional view taken along lines 5—5 of FIG. 2.
Figure 6:
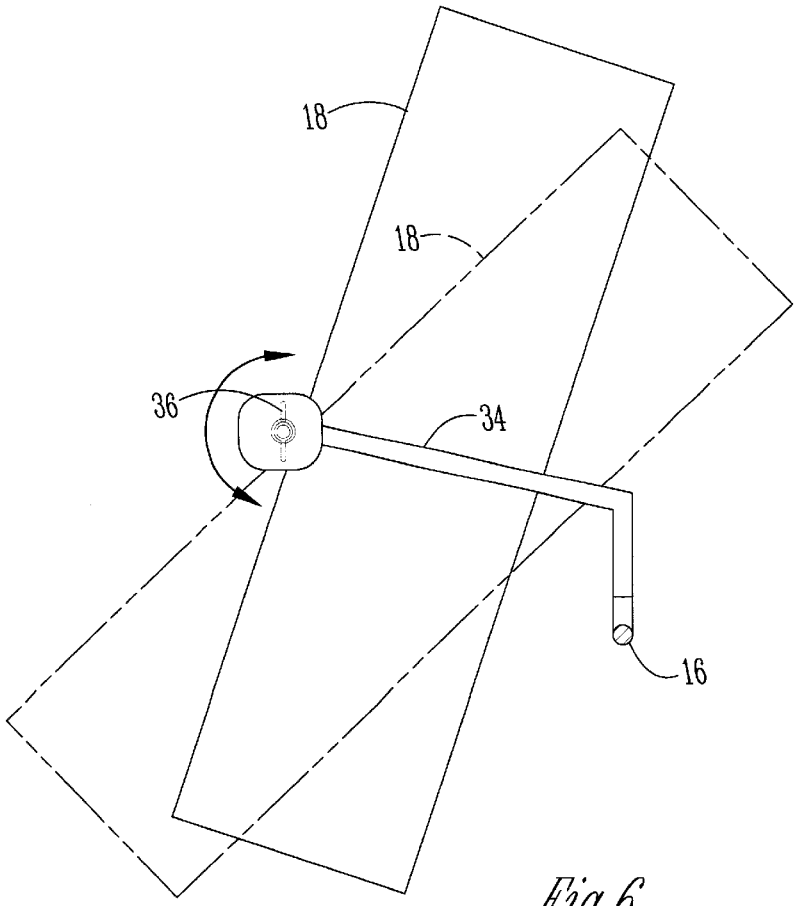
FIG. 6 is a side elevation view taken along lines 6—6 of FIG. 3.

The upper end of the first arm 14 is hollow and telescopically receives the lower end of the L-shaped second arm 16, as best seen in FIGS. 2 and 3. A spring loaded pin 30 extends through the first arm 14 and through one of a plurality of holes 41 in the second arm 16. The pin 30 can be retracted so the second arm 16 can be slideably moved upwardly or downwardly within the first arm 14, thereby adjusting the height of the book rack 18.

The second arm 16 includes a rack support or yoke 34 extending to opposite sides of the rack 18 and pivotally secured thereto by wing nuts 36, or any other convenient pivotal attachment mechanism. Thus, the rack 18 is pivotally supported by the yoke 34 such that the angle of the rack is adjustable.

The book rack 18 includes a shelf 38 to support a book 40. A page retainer 42 is pivotally connected to the shelf 38. The precise structure of the pivot connection between the shelf 38 and the page retainer 42 is not shown, but it is understood that such pivot connection may be a hinge, a spring, a rubber connector, a slip fit, or any other pivotal attachment allowing the page retainer 42 to move between a first position engaging the pages of the book 40, as shown in solid lines in FIG. 4, to a second position disengaged from the book pages, as shown in broken lines in FIG. 4. In the second position, the book pages can be easily turned, and the page retainer 42 then moved back to the first position to hold the pages open.

Preferably, the page retainer 42 is I-shaped, and includes a central beam 44 and laterally extending upper and lower fingers 46, 48. The upper and lower fingers 46, 48 extend across the upper and lower margins of the book pages, with the text residing between the fingers 46, 48. Thus, the fingers do not obstruct any text, and the reader may highlight or underline desired text. The central beam 44 includes telescoping segments 50, 52, such that the distance between the upper and lower fingers 46, 48 can be adjusted. The segments 50, 52 may be constructed similar to the arms 14, 16, with a spring loaded pin extending through one of a plurality of holes in the upper segment 52. Alternatively, the segments 50, 52 may be frictionally assembled for slidable movement relative to one another. A battery powered light 54 may be mounted on the rack 18 so as to illuminate the pages of the book 40.

In use, a reader positions the base 12 of the book stand 10 beneath his or her leg or buttocks while seated. The first arm 14 is pivoted such that the rack 18 is at a desired distance from the reader's eyes. The height of the rack 18 is adjusted by telescoping the second arm 16 relative to the first arm 14, via the retainer pin 30. The angle of the rack 14 and book 40 are adjusted by loosening and tightening the wing nuts 36. The page retainer 42 is moved to the second position, so that the book can be positioned on the shelf 38 and opened to the desired pages. Page retainer 42 is then pivoted into engagement with the book pages so as to hold the book open. Thus, the reader's arms are free from holding the book. To turn the book pages, the page retainer is quickly and easily pivoted from the first page retaining position to the second position so that the pages are free to be turned.

The book stand 10 is lightweight and portable so that it can be used indoors or outdoors, or in a motor vehicle, such as a car, truck or bus.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A book stand comprising:

a flat base adapted to fit under a seated person's leg or buttocks to stabilize the book stand;

a support member operatively and telescopically attached to the base and extending substantially vertically;

a book rack mounted on the support member and adapted to support a book; and a page retainer mounted on the book rack and having an upwardly extending center beam with laterally extending upper and lower fingers for holding opposing pages of a book open for reading, the retainer being pivotally mounted on the rack for movement between a first page retaining position and a second page turning position.

2. The book stand of claim 1 wherein the distance between the upper and lower fingers is variable to accommodate different sized books.

3. The book stand of claim 2 wherein the center beam of the page retainer includes telescoping segments to vary the distance between the upper and lower page fingers.

4. The book stand of claim 1 wherein the support member is pivotally connected to the base about a horizontal axis to allow the distance between the rack and the reader to be adjustable.

5. The book stand of claim 1 wherein the rack is pivotally connected to the support member such that the angle of the rack is adjustable.

6. The book stand of claim 1 further comprising a light mounted on the rack for illuminating the book pages.

7. A book stand for supporting a book having a plurality of pages and holding the pages open for reading, comprising:

a flat base adapted to be sat on by a reader so as to stabilize the stand free from stabilization hardware;

a first arm pivotally connected to the base for pivotal movement about a horizontal axis transverse to the reader's legs to allow adjustable spacing between the reader and the book;

a second arm telescopically extending from the first arm to allow height adjustment of the book;

a book rack to support a book and being pivotally mounted on the second arm to allow angular adjustment of the book; and a page retainer extendible across opposing open pages of the book to hold the pages open for reading.

8. The book stand of claim 7 wherein the page retainer is pivotally connected to the rack for movement between a first position in engagement with the book pages and a second position disengaged from the book pages.

9. The book stand of claim 7 wherein the page retainer is I-shaped with upper and lower fingers for holding open the book pages.

10. The book stand of claim 9 wherein the page retainer includes a central beam with telescoping segments to allow adjustable spacing between the upper and lower fingers.

11. The book stand of claim 7 further comprising a light operatively mounted on the rack.

12. A book stand for supporting a book having a plurality of pages and holding the pages open for reading, comprising:

a flat base adapted to be sat on by a reader so as to stabilize the stand free from stabilization hardware;

a first arm pivotally connected to the base for pivotal movement about a horizontal axis transverse to the reader's legs to allow adjustable spacing between the reader and the book;

a second arm telescopically extending from the first arm to allow height adjustment of the book;

a book rack to support a book and being pivotally mounted on the second arm to allow angular adjustment of the book; and a page retainer pivotally connected to the rack for movement between a first position in engagement with the book pages and a second position disengaged from the book pages and extendible across opposing opened pages of the book to hold the pages open for reading.

13. A book stand for supporting a book having one or more pages and holding the pages open for reading, comprising:

a flat base adapted to be sat on by a reader so as to stabilize the stand free from stabilization hardware;

a first arm pivotally connected to the base for pivotal movement about an axis transverse to the reader's legs to allow adjustable spacing between the reader and the book;

a second arm telescopically extending from the first arm to allow height adjustment of the book;

a book rack to support a book and being pivotally mounted on the second arm to allow angular adjustment of the book; and a page retainer extendible across opposing opened pages of the book to hold the pages open for reading wherein the page retainer is I-shaped with upper and lower fingers for holding open the book pages.

14. The book stand of claim 13 wherein the page retainer includes a central beam with telescopic segments to allow adjustable spacing between the upper and lower fingers.

* * * * *